US007975682B2

(12) United States Patent
Yang

(10) Patent No.: US 7,975,682 B2
(45) Date of Patent: Jul. 12, 2011

(54) DUPLEX CONTROL STRUCTURE OF TOY GUN

(76) Inventor: Chung-Kuan Yang, Taipei County (TW)

( * ) Notice: Subject to any disclaimer, the term of this patent is extended or adjusted under 35 U.S.C. 154(b) by 406 days.

(21) Appl. No.: 12/327,038

(22) Filed: Dec. 3, 2008

(65) Prior Publication Data

US 2010/0065033 A1 Mar. 18, 2010

(30) Foreign Application Priority Data

Sep. 12, 2008 (TW) ..... 97135258 A

(51) Int. Cl.
*F41B 11/00* (2006.01)

(52) U.S. Cl. ..... 124/67; 124/64; 124/65; 124/66

(58) Field of Classification Search ..... 124/64, 124/65, 66, 67, 73
See application file for complete search history.

(56) References Cited

U.S. PATENT DOCUMENTS

| | | | | |
|---|---|---|---|---|
| 5,261,384 | A * | 11/1993 | Hu | 124/66 |
| 5,381,928 | A * | 1/1995 | Lee et al. | 222/79 |
| 6,564,788 | B1 * | 5/2003 | Hu | 124/66 |
| 7,694,448 | B2 * | 4/2010 | Iwasawa | 42/54 |
| 7,712,462 | B2 * | 5/2010 | Pedicini et al. | 124/65 |
| 7,730,881 | B1 * | 6/2010 | Pedicini et al. | 124/65 |
| 7,878,184 | B2 * | 2/2011 | Klarborg | 124/65 |
| 2003/0098019 | A1 * | 5/2003 | Hu | 124/66 |
| 2005/0188974 | A1 * | 9/2005 | Pedicini et al. | 124/65 |
| 2005/0235975 | A1 * | 10/2005 | Pedicini et al. | 124/67 |
| 2006/0137671 | A1 * | 6/2006 | Chu | 124/32 |
| 2006/0231083 | A1 * | 10/2006 | Tsurumoto | 124/66 |
| 2006/0243263 | A1 * | 11/2006 | Tsurumoto | 124/66 |
| 2007/0000483 | A1 * | 1/2007 | Tsurumoto | 124/73 |
| 2007/0289586 | A1 * | 12/2007 | Tsurumoto | 124/73 |
| 2009/0056693 | A1 * | 3/2009 | Pedicini et al. | 124/73 |

* cited by examiner

*Primary Examiner* — Troy Chambers
(74) *Attorney, Agent, or Firm* — WPAT, PC; Justin King

(57) ABSTRACT

A duplex control structure of toy gun includes a main body (3), a control portion (1), a transmission portion (2), and a motor (4). The main body (3) further consists of a left and right main bodies (3*a*), (3*b*), a barrel (31), two motor's positioning plates (32*a*) and (32*b*), a multiplicity of supporting shaft rods (33), (34), a left and right handle portions (35*a*), (35*b*), check plates (36*a*), (36*b*), and two sliding ways (37*a*), (37*b*). The control portion (1) further consists of a trigger (11), a control rod (12), a propping up plate (13), a brake (14), a slider rod (15), a positioning plate (25), a pull knob (17), and a power switch (18). The transmission portion (2) consists of a gun machine socket (21), a piston (22), springs (23), (24), a positioning plate (25), a check piece (26), a clip piece (27), a small transmission gear (28), and a large transmission gear (29). The motor (4) is connected to a DC power supply. By making use of the pull knob (17) to drive the propping up plate to press against or separate from the corresponding control rod (12) in accommodating the action of the positioning plate (25) of the control portion (1), the invention is capable of achieving the objective of duplex driving functions of a manually and electrically shooting toy gun.

13 Claims, 9 Drawing Sheets

DUPLEX CONTROL STRUCTURE OF TOY GUN

BACKGROUND OF THE INVENTION

1. Field of the Invention

The invention relates to a duplex control structure of toy gun, and more particularly, to a duplex control structure of toy gun having both manually and electrically driving modes.

2. Description of the Prior Art

Among the current common toy gun products having projectile plastic (PP) bullet, there are manual and electrical types of structure. The electric type of toy gun makes use of a motor for driving the piston to perform reciprocating motion in a cylinder for propelling a piston to generate high-pressure air for projecting off the plastic bullets. However, the manual type of toy gun makes use of the resilient spring force released from the compressed spring for propelling a piston to generate high-pressure air for projecting off the plastic bullets. These two types of structure are significantly different since their power sources are different.

As far as the structure of the manual type of toy gun is concerned, a relatively simpler one propels the piston for compressing the spring by a manually pulling type of action. This kind of structure of the toy gun lacks of enjoyment while one is playing on the gun since it has only the function of a single shooting. However, there is another one which has both the functions of single shooting and continuous shooting through a switching action by the use of an electric power motor to compress the spring via the transmitting mechanism to drive the piston. This one is relatively enjoyable while one is playing on the gun. Nevertheless, as far as the current products are concerned, the way of driving exists only in a single state no matter whether it is a manual or electric motor's driving, and there are no such kinds of structure having both the manually and electrical motor's driving types of today. Consequently, the fact that the electrically driving toy gun is unable to function once the electric power is used up forms a demerit upon usage, thereby it lacks product competitiveness on the market.

SUMMARY OF THE INVENTION

In light of the above-mentioned disadvantages that the toy gun does not have both the manual and electrical driving controls, the invention aims to ameliorate the disadvantage of the prior art or to provide a useful alternative.

The primary objective of the invention is to provide a duplex control structure of toy gun having both of the manually and electrically driving methods to provide the user more variation and enjoyment in playing the toy gun.

To achieve the above-mentioned objective, the invention provides a duplex control structure of toy gun includes a main body (3), a control portion (1), a transmission portion (2), and a motor (4). The main body (3) further consists of a left and right main bodies (3*a*), (3*b*), a barrel (31), two motor's positioning plates (32*a*) and (32*b*), a multiplicity of supporting shaft rods (33), (34), a left and right handle portions (35*a*), (35*b*), check plates (36*a*), (36*b*), and two sliding ways (37*a*), (37*b*). The control portion (1) further consists of a trigger (11), a control rod (12), a propping up plate (13), a brake (14), a slider rod (15), a positioning plate (25), a pull knob (17), and a power switch (18). The transmission portion (2) consists of a gun machine socket (21), a piston (22), springs (23), (24), a positioning plate (25), a check piece (26), a clip piece (27), a small transmission gear (28), and a large transmission gear (29). The motor (4) is connected to a DC power supply. By making use of the pull knob (17) to drive the propping up plate to press against or separate from the corresponding control rod (12) in accommodating the action of the positioning plate (25) of the control portion (1), the invention is capable of achieving the objective of duplex driving functions of a manually and electrically shooting toy gun.

The accomplishment of this and other objectives of the invention will become apparent from the following description and its accompanying drawings of which:

DETAILED DESCRIPTION OF THE PREFERRED EMBODIMENT

Figure 1:
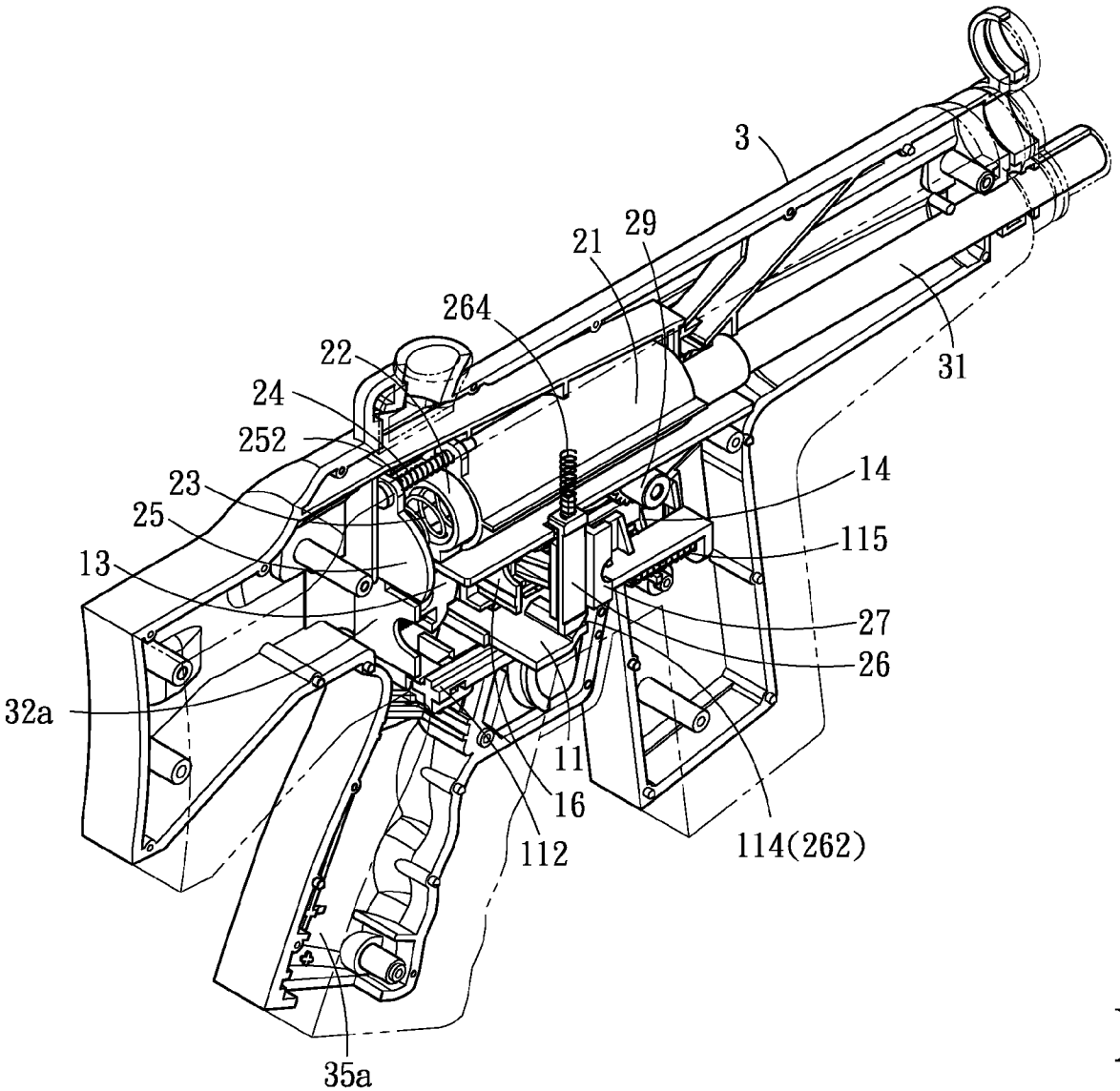
FIG. 1 is an isometric view of the preferred embodiment of the assembled duplex control structure of toy gun of the invention.
Figure 2:
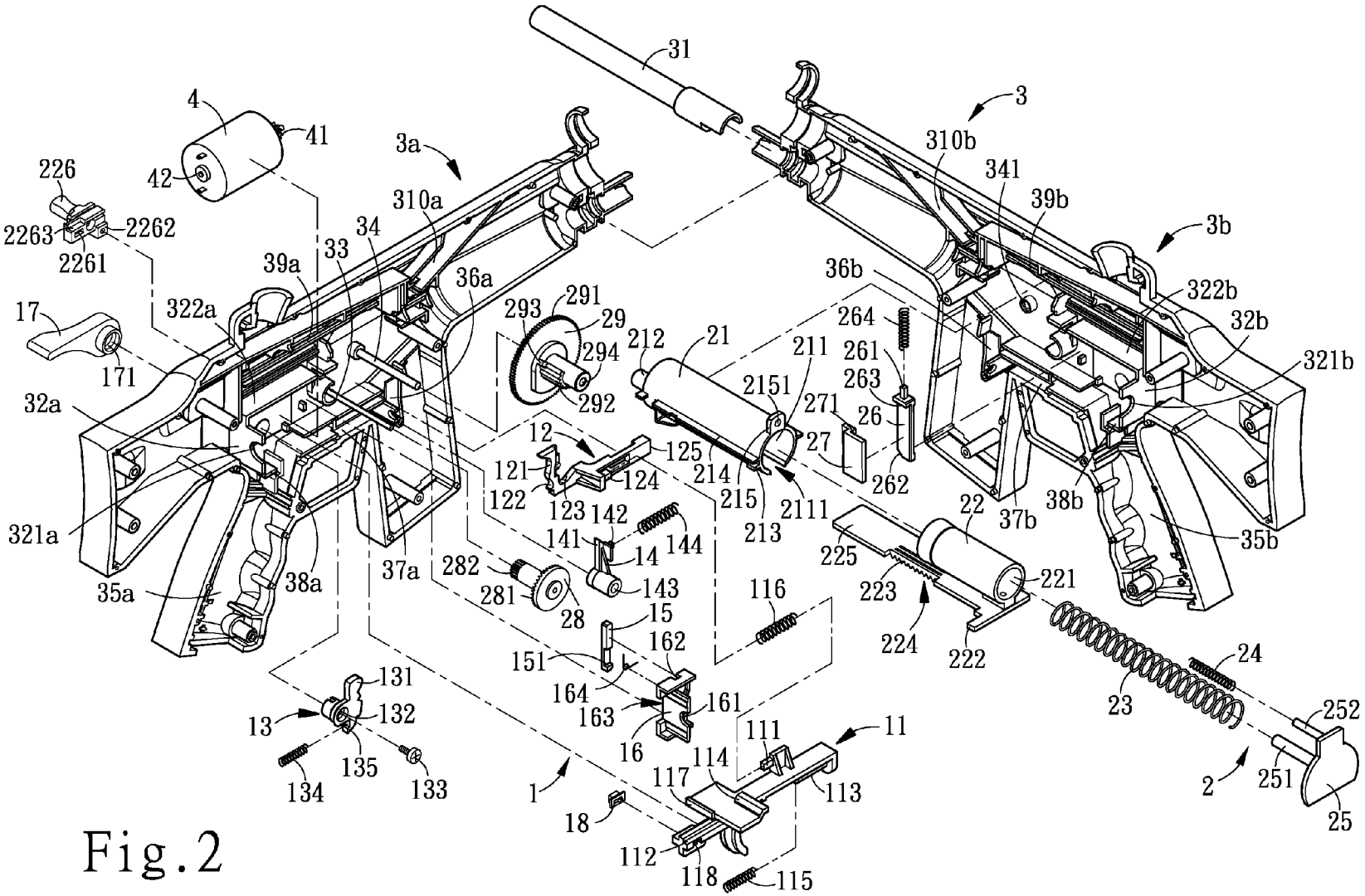
FIG. 2 is an exploded view of the preferred embodiment of toy gun of the invention.
Figure 3:
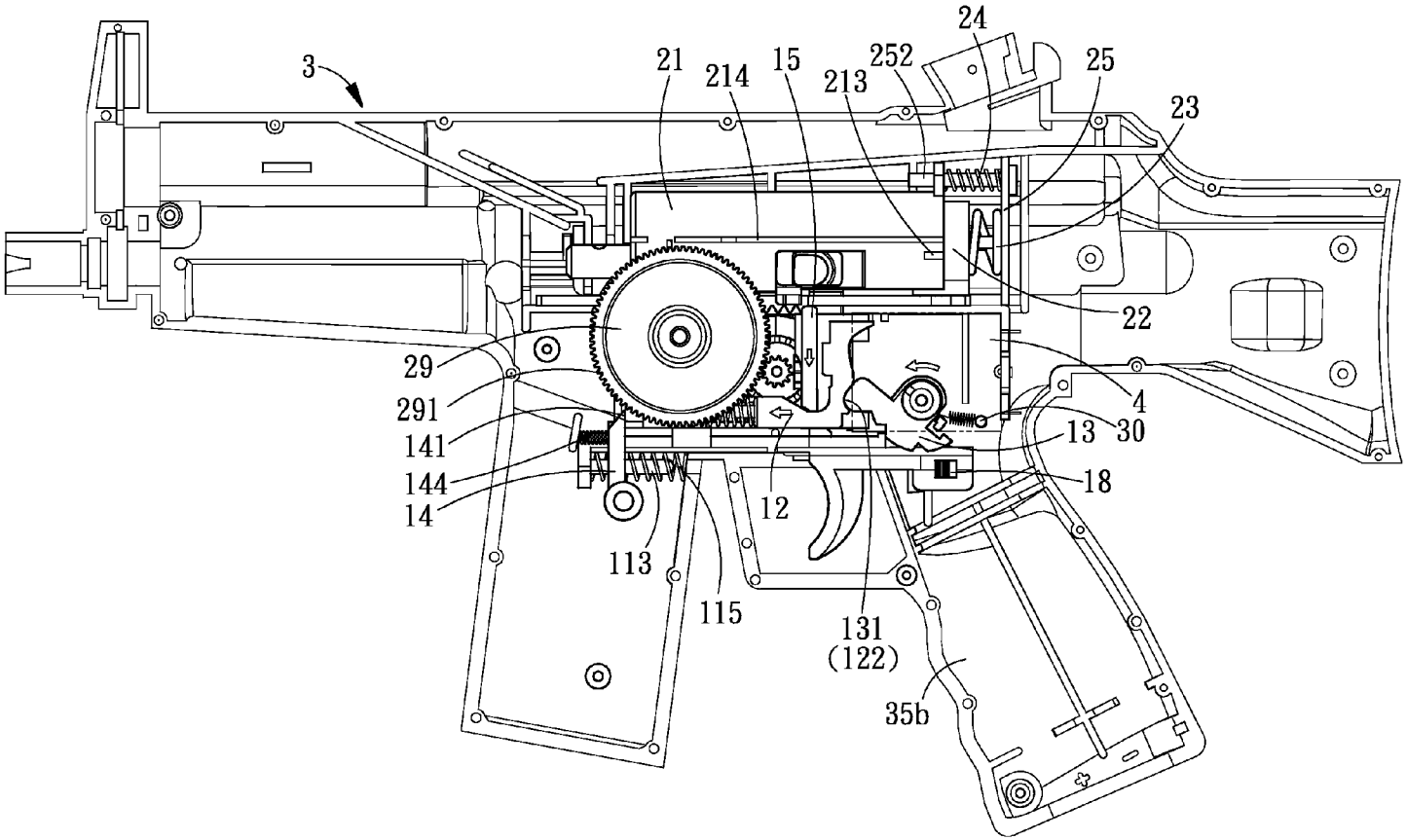
FIG. 3 is a fragmentary cross-sectional view (I) of the preferred embodiment of the assembled manually driving toy gun structure of the invention.
Figure 4:
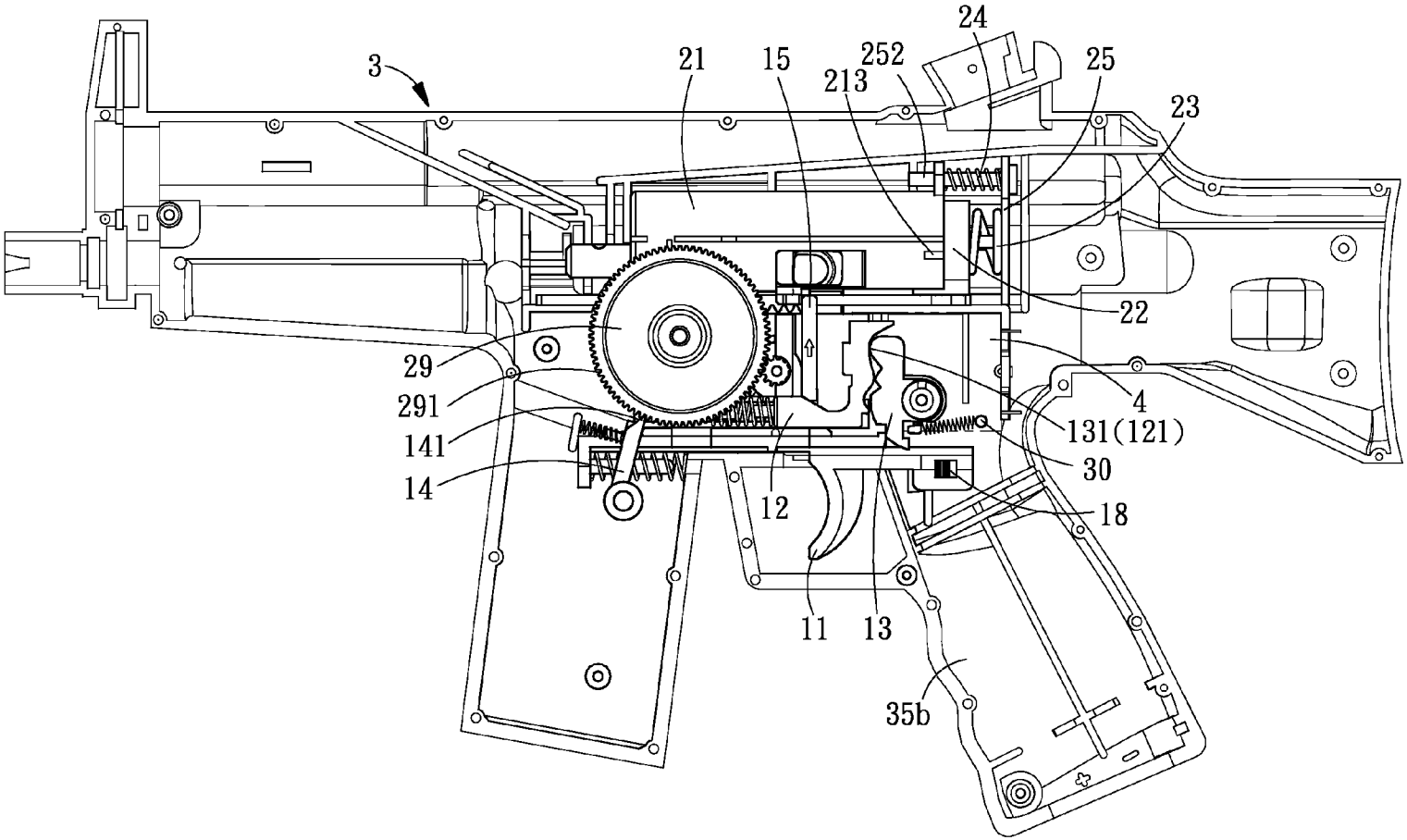
FIG. 4 is a fragmentary cross-sectional view (II) of the preferred embodiment of the assembled manually driving toy gun structure of the invention.
Figure 5:
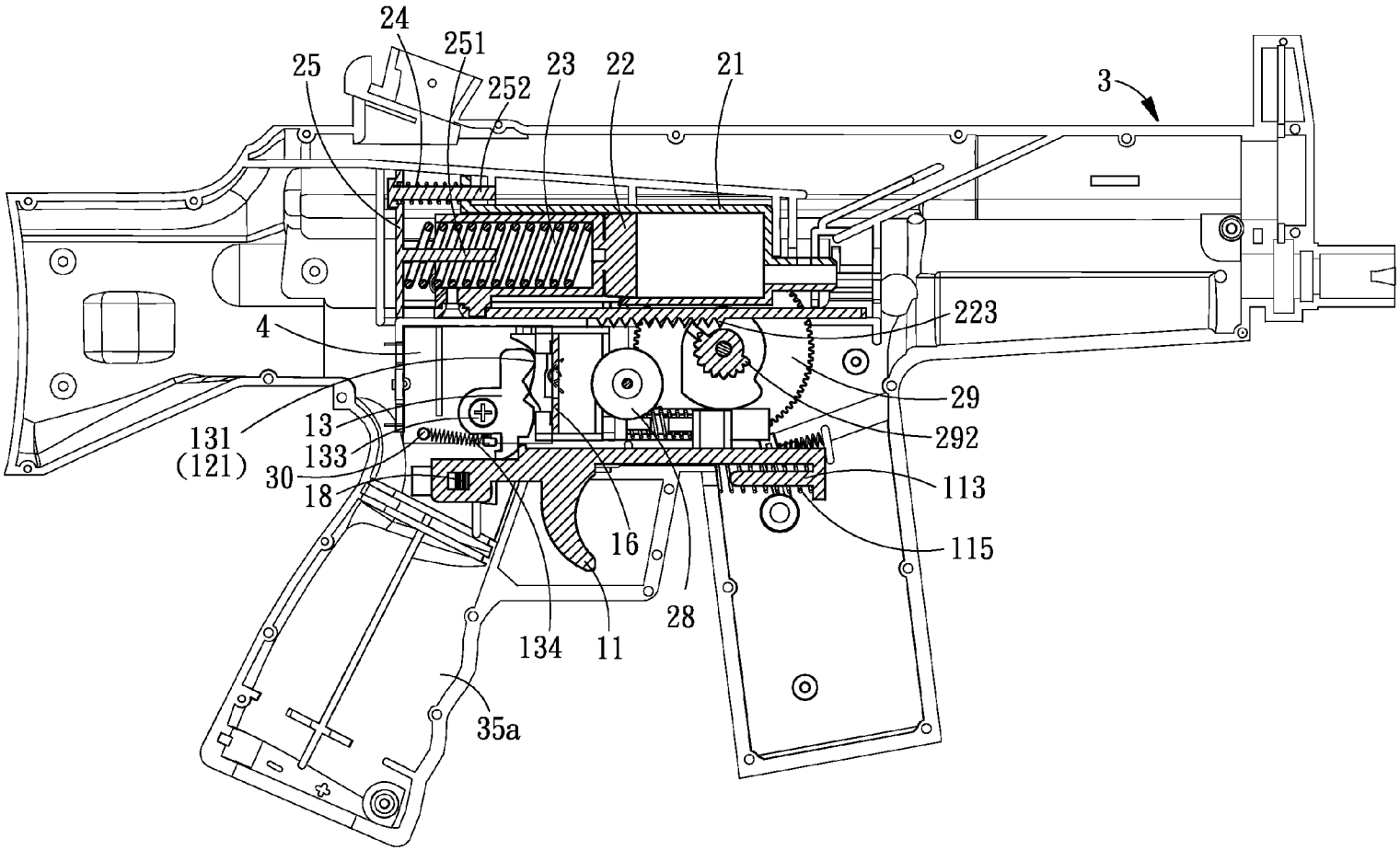
FIG. 5 is a fragmentary cross-sectional view (III) of the preferred embodiment of the assembled manually driving toy gun structure of the invention.

FIG. 1 is an isometric view of the preferred embodiment of the assembled duplex control structure of toy gun of the invention; FIG. 2 is an exploded view of the preferred embodiment of toy gun of the invention; FIG. 3 is a fragmentary cross-sectional view (I) of the preferred embodiment of the assembled manually driving toy gun structure of the invention; FIG. 4 is a fragmentary cross-sectional view (II) of the preferred embodiment of the assembled manually driving toy gun structure of the invention; FIG. 5 is a fragmentary cross-sectional view (III) of the preferred embodiment of the assembled manually driving toy gun structure of the invention. As shown in FIG. 1, FIG. 2, FIG. 3, FIG. 4, and FIG. 5, the duplex control structure of toy gun of the invention includes a main body (3), a control portion (1), a transmission portion (2), and a motor (4).

The main body (3) consisting of a left and right main bodies (3*a*), (3*b*) has a barrel (31) provided at the bullet outlet and a fastening potion. Two motor's positioning plates (32*a*) and (32*b*) having recesses (321*a*) and (321*b*) are provided near the rear end of the left main body (3*a*) and the right main body (3*b*) respectively. Two slider portions (322*a*) and (322*b*) are also provided at the upward extended horizontal portion of the motor's positioning plates (32*a*) and (32*b*). A multiplicity of supporting shaft rods (33) and (34) are provided by inserting in a shaft seat slot (341). A handle having left and right handle portions (35*a*), (35*b*) with inner containing space for containing the batteries are provided by extending downward from the main body (3). Two check plates (36*a*), (36*b*) are provided in the middle section of the left and right main bodies (3*a*), (3*b*) therein. Two sliding ways (37*a*), (37*b*) are provided in horizontal and upper rear positions of the check plates (36*a*), (36*b*). Two guide plates (38*a*), (38*b*) are provided in horizontal and lower front positions of the motor's positioning plates (32*a*) and (32*b*). Two bullet inlet sliding ways (310*a*), (310*b*) having sliding slots (39*a*), (39*b*) provided below are furnished in the front section of the main body (3).

The control portion (1) consists of a trigger (11), a control rod (12), a propping up plate (13), a brake (14), a slider rod (15), a positioning plate (16), a pull knob (17), and a power switch (18). Among them, the trigger (63) being a plate structure has a salient post (111) furnished in the upper part near the front section with a corresponding spring (116) slipped thereon. A post rod (113) with a corresponding spring (115) slipped thereon is also provided below the salient post (111). In the rear section, there are a slant portion (114), a flange (117), a cross-slot rail (112) extended in sequence where a penetrated inserting hole (118) is provided under the cross-slot rail (112). The control rod (12) being a stepped rod body has an end upward offset goose neck with an upper recess portion (121) provided on the outer side and a lower recess portion (122) downward extended, as well as a slant surface (123) furnished at the neck portion. Besides, a slant portion (124) is provided at the middle section of the control rod (12) while an end surface (115) is formed at the other end of the control rod (12). The propping up plate (13) has a threaded hole (132) for threading a screw (133) therein, a slant portion (131), a hook portion (135) for hooking a spring (134). The brake (14) has a shaft portion (143) that extends a check plates (141) furnished at the circumference thereon and a slant portion (142) for a spring (144) slipped there on. The slider rod (15) has a dented edge (151) at the lower end thereof. The positioning plate (16) has a recess portion (161), a sliding slot (162), and a salient portion (163) for hooking a spring (164). The pull knob (17) has a threaded hole (171).

The transmission portion (2) consists of a gun machine socket (21), a piston (22), two springs (23), (24), a positioning plate (25), a check piece (26), a clip piece (27), a small transmission gear (28), and a large transmission gear (29). Among them, the gun machine socket (21) being a hollow tube has a penetration tube hole (211) formed therein, a sliding slot (2111) provided at the open rear end, an outlet end (212) provided at the front end, and a horizontal wing plate (214) furnished on each side thereof. A check portion (213) is furnished adjacent to the sliding slots (2111) below one of the wing plate (214). A lug (215) having a penetration hole (2151) at the center thereof is furnished at the open end of the slot hole (211) of the gun machine socket (21). The piston (22) being a tube structure corresponding to the gun machine socket (21) forms a non-penetrating tube hole (221) therein. A sliding plate (225) being integrally formed with the gun machine socket (21) has a breach (224) provided on a side, a lower dent (223) in the middle section on a side (see FIG. 2), and a salient portion (222) that is provided at the open end of the non-penetrating tube hole (221) and is corresponding to and combined with a gun machine pulling handle (226).

The gun machine pulling handle (226) has a groove (2261) on a side thereof, a salient portion (2262), and a recess portion (2263) that is corresponding to the check portion (213) at the open end of the penetration tube hole (211). The positioning plate (25) has two columns (251) and (252) for the springs (23) and (24) to be slipped on respectively. The positioning plate (25) has its column (251), after being slipped on by the spring (23), that is inserted into the non-penetrating tube hole (221) of the piston (22) while the column (252), after being slipped on the spring (24), is inserted through the corresponding hole (2151) of the lug (215) on the gun machine socket (21). The check piece (26) being a plate in shape has a horizontal bent portion (263) at the top end thereof, a salient portion (261) provided at the top surface of the horizontal bent portion (263) for a spring (264) to be slipped on, and a chamfer (262) at a corner of the lower end thereof. The clip piece (27) has a stepped front end (271). The small transmission gear (28) has a front tooth portion (282) at one end and a rear tooth portion (281) at the other end while the large transmission gear (29) has a tooth portion (291) at one end, a transmission tooth portion (292) at the other end, a salient portion (293) on a side, and a shaft hole (294) penetrated through the center thereof.

The motor (4) being connected to a DC (direct current) power supply (DC batteries are used in the invention) has a tooth portion (41) at one end and a salient portion (42) at the other end.

As shown in FIG. 1~FIG. 5, when it comes to assembling, first of all, the trigger (11) is inserted into the corresponding left and right main body (3*a*), (3*b*) letting the spring (115) slip through the post rod (113), then insert the combination into the corresponding left and right main bodies (3*a*), (3*b*), in the meantime, having the spring (116) be slipped on the salient post (111) and insert into the salient portion (124) of the control rod (12); afterwards, the spring (164) after hooking into the post rod (113) of the trigger (11) has its one end that is pressed in the dented edge (151) and has the slider rod (15) that is inserted into the sliding slots (162) of the positioning plate (16) and has the other end of the spring (164) that is pressed therein. The positioning plate (16) is inserted into the corresponding positions of the left and right main bodies (3*a*), (3*b*) that are exactly above the trigger (11), in the meantime, the power switch (18) is exactly inserted in the inserting hole (118) at an end of the trigger (11) while the cross-slot rail (112) on top of the inserting hole (118) is provided to slide on the guide plates (38*a*), (38*b*) of the left and right main bodies (3*a*), (3*b*). The propping up plate (13) is secured to the pull knob (17) by the use of a screw (133) penetrating through the threaded hole (132) and a penetration hole at the left main bodies (3*a*) to thread in the threaded hole (171), in the meantime, the salient portion (131) correspondingly performs action with the upper recess portion (121) and the lower recess portion (122) of the control rod (12) while the hook portion (135), after hooking the spring (134), is secured to the corresponding fastening potion (30) of the left main body (3*a*). The shaft portion (143) of the brake (14) is slipped on the corresponding position of the main body (3) while the check plates (141) of the brake (14) performs slide-pressing against the tooth portion (291) of the large transmission gear (29). The spring (144), after slipping on the salient portion (142), presses against the corresponding position on the main body (3). The slider rod (15) is embedded into the corresponding sliding slots (162) of the positioning plate (16) and the dented edge (151) of the slider rod (15) exactly presses against the spring (164) that is hooked to the salient portion (163) of the positioning plate (16). Besides, the recess portion (161) of the positioning plate (16) is exactly fitted into the salient portion (42) of the motor (4).

The transmission portion (2) having the piston (22) insert into the corresponding penetration tube hole (211) of the gun machine socket (21) has its sliding slot (2111) that is provided for the piston (22) to slide back-and-forth and has the non-penetrating tube hole (221) that is provided for the spring (23) and the columns (251) of the positioning plate (25) to be inserted in correspondingly. The other columns (252), after having the spring (24) slipped on, are inserted into the corresponding penetration hole (2151) of the lug (215). The gun machine socket (21) has its outlet end (212) that is furnished to be corresponding to the barrel (31), and has its wing plate (214) that is inserted in the sliding ways (37*a*), (37*b*) of the left and right main bodies (3*a*), (3*b*) while the check portion (213) furnished adjacent to the sliding slot (2111) of the wing plate (214) is fitted to the corresponding recess portion (2263).

The piston (22) has its salient portion (222) of the sliding plate (225), that is integrally formed with the tube body thereof, that is protruded out of the main body (3) and fit in the groove (2261) of the gun machine pulling handle (226) while the lower dent (223) furnished beneath the sliding plate (225) performs meshing action with the corresponding transmission tooth portion (292) of the large transmission gear (29) (see FIG. 5). In addition, the salient portion (222) positioned on the sliding plate (225) and adjacent to the open end of the non-penetrating tube hole (221) is combined with the corresponding gun machine pulling handle (226). The positioning plate (25) has two columns (251) and (252) for the springs (23) and (24) to be slipped on respectively. The positioning plate (25) has its column (251), after being slipped on by the spring (23), that is inserted into the non-penetrating tube hole (221) of the piston (22) while the column (252), after being slipped on the spring (24), is inserted through the corresponding hole (2151) of the lug (215) on the gun machine socket (21). The check piece (26) being a plate in shape has a salient portion (261) that is provided at the top surface for a spring (264) to be slipped on, a horizontal bent portion (263) at the top end thereof, and a chamfer (262) at a corner of the lower end thereof. The clip piece (27) has a stepped front end (271). The small transmission gear (28) has a front tooth portion (282) at one end and a rear tooth portion (281) at the other end while the large transmission gear (29) has a tooth portion (291) at one end, a transmission tooth portion (292) at the other end, a salient portion (293) provided on a side, and a shaft hole (294) penetrated through the center thereof. The motor (4) being connected to a DC (direct current) power supply (DC batteries are used in the invention) has a tooth portion (41) at one end and a salient portion (42) at the other end.

Figure 8:
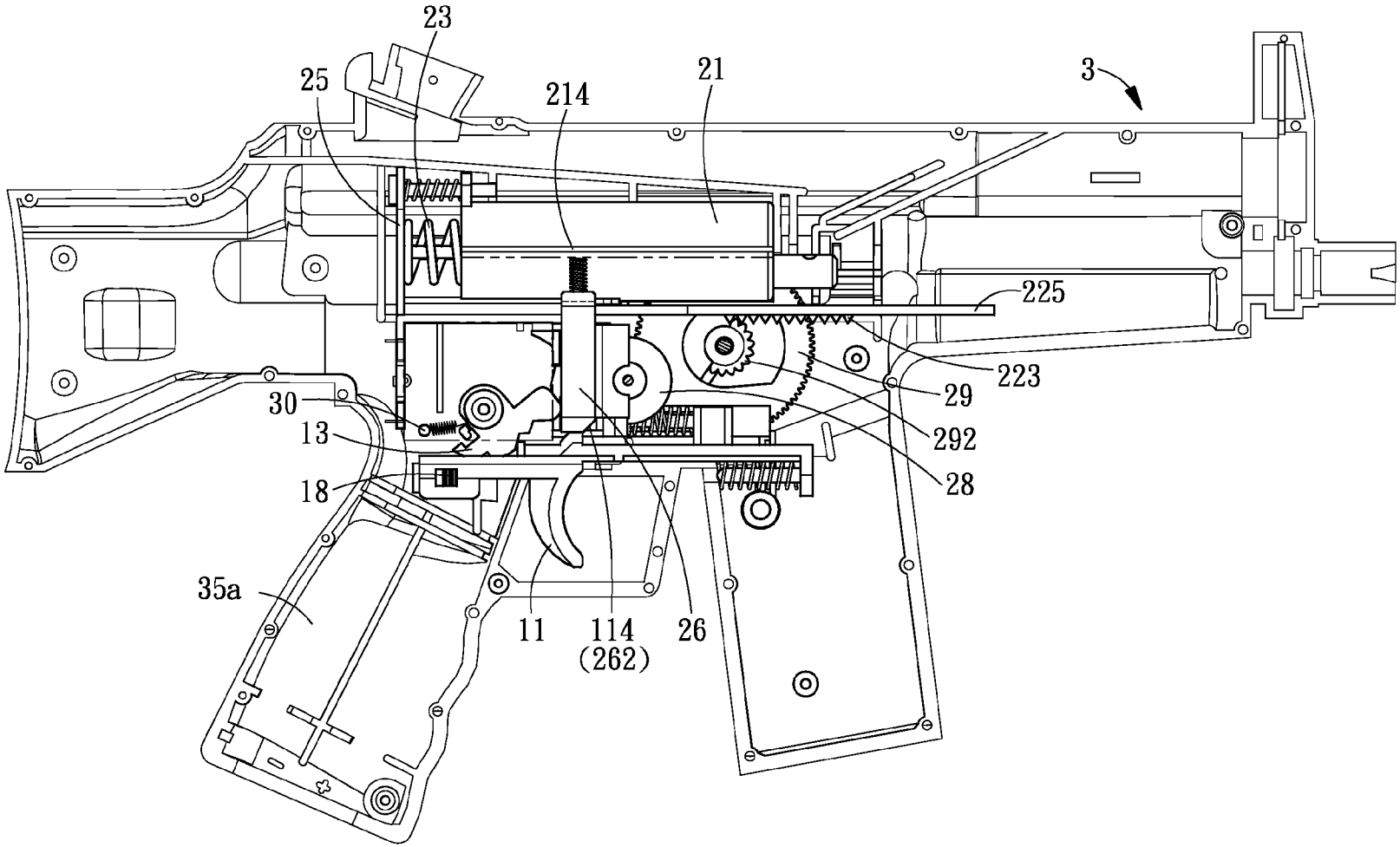
FIG. 8 is a fragmentary cross-sectional view (I) showing the action of the check piece and the check plate of the preferred embodiment of the assembled manually driving toy gun structure of the invention.
Figure 9:
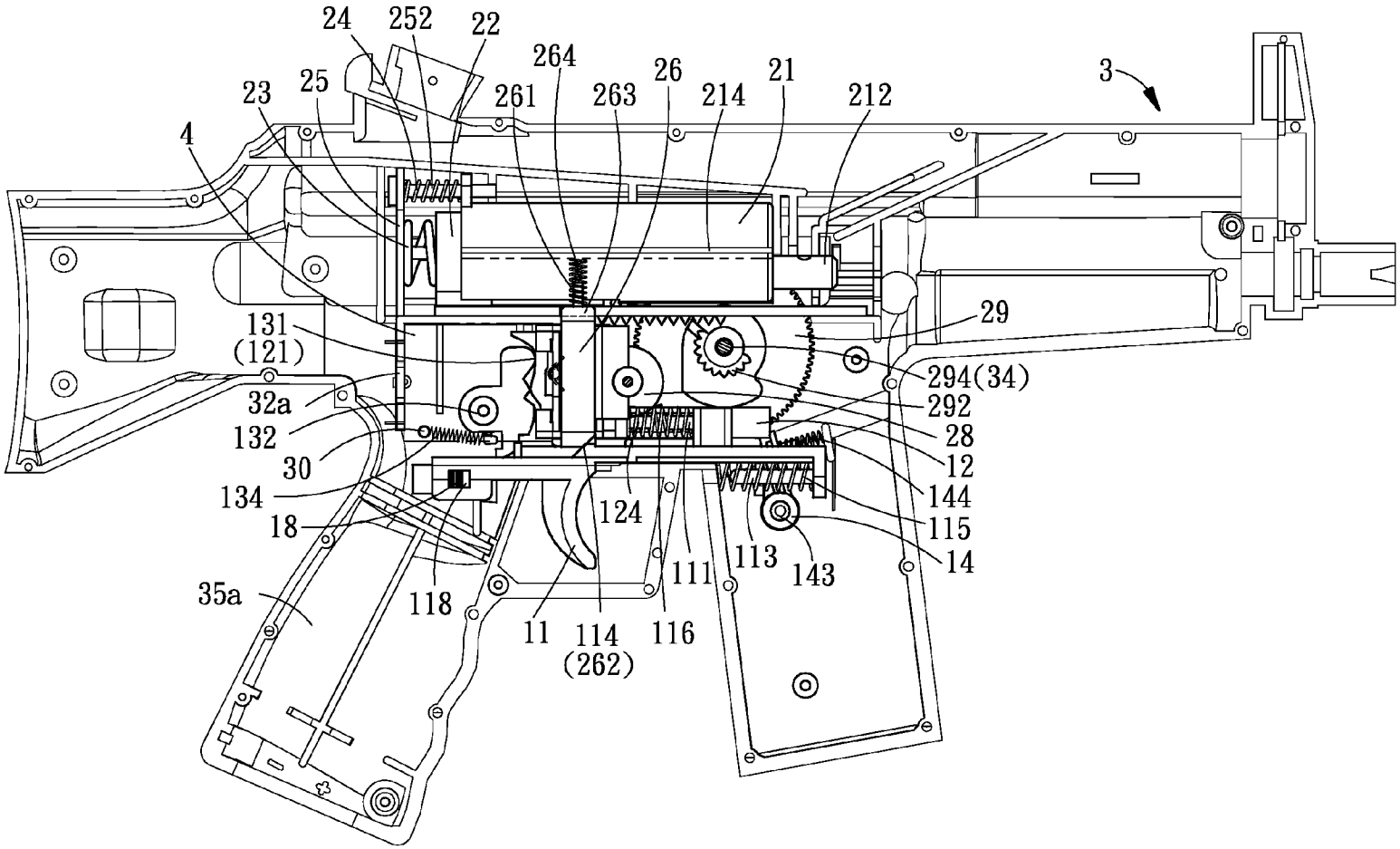
FIG. 9 is a fragmentary cross-sectional view (II) showing the action of the check piece and the check plate of the preferred embodiment of the assembled manually driving toy gun structure of the invention.

FIG. 8~FIG. 9 are fragmentary cross-sectional views showing the action of the check piece and the check plate of the preferred embodiment of the assembled manually driving toy gun structure of the invention. As shown in FIG. 3~FIG. 5, and FIG. 8~FIG. 9, when it comes to operating, the operator pulls the pull knob (17) toward the front end direction of the barrel (31) to drive the propping up plate (13) to rotate, it will make the salient portion (131) of the propping up plate (13) moving from the upper recess portion (121) down to the lower recess portion (122). It will also make the control rod (12) move forward as shown in FIG. 3. In consequence, the downward disposed slant surface (123) will exactly make the slider rod (15) slide downward to release the catching of the breach (224) on a side of the piston (22). At this moment, the operator is capable of pulling the gun machine pulling handle (226) to drive the piston (22) to perform backward displacement making the recess portion (2263) exactly press against the check portion (213) of the gun machine socket (21). Consequently, it makes the outlet end (212) of the gun machine socket (21) perform backward displacement through the bullet inlet sliding ways (310*a*), (310*b*) to facilitate the bullet entering the ready-shooting position. As the piston (22) keeps on performing backward displacement till the limiting position and stops for positioning, the chamfer (262) at the corner of the lower end of the check piece (26) is exactly fitted in the corresponding slant portion (114) of the trigger (11). What is more, as the operator lightly presses the trigger (11) backward, the slant portion (114) will quickly push the chamfer (262) at the lower end of the check piece (26) to generate ready-shooting action that makes the plastic bullet enter the barrel (31) through the bullet inlet sliding ways (310*a*), (310*b*) and shoot off via the barrel (31). In case that the operator pulls the pull knob (17) backward as shown in FIG. 4, the control rod (12) will perform forward displacement making the lower end of the slider rod (15) raise upward, at this moment, the top end of the slider rod (15) will be exactly fitted in the breach (224) of the piston (22) and be limited the displacement of the piston (22).

Figure 6:
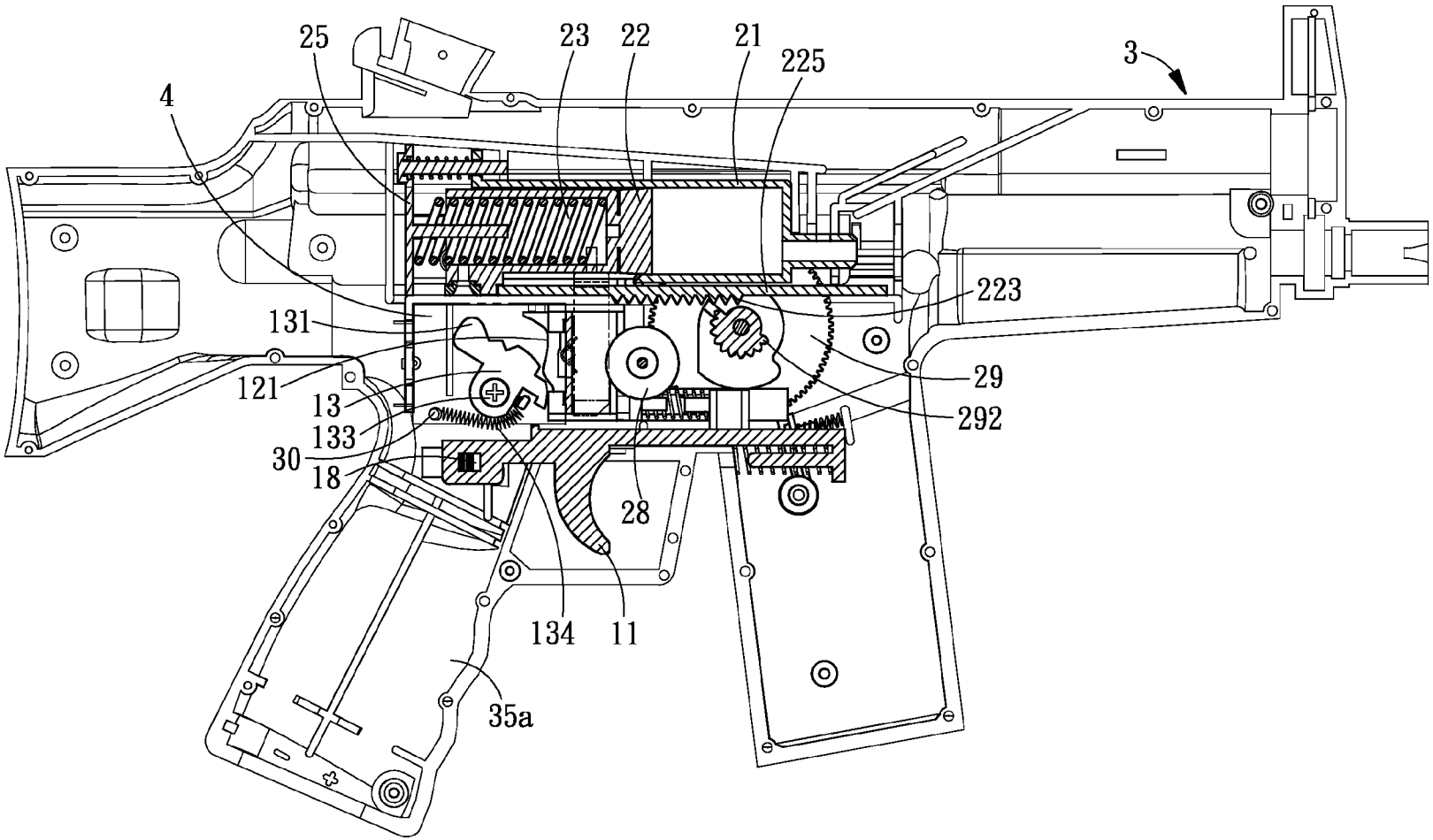
FIG. 6 is a fragmentary cross-sectional view (I) of the other embodiment of the assembled electrically driving toy gun structure of the invention.
Figure 7:
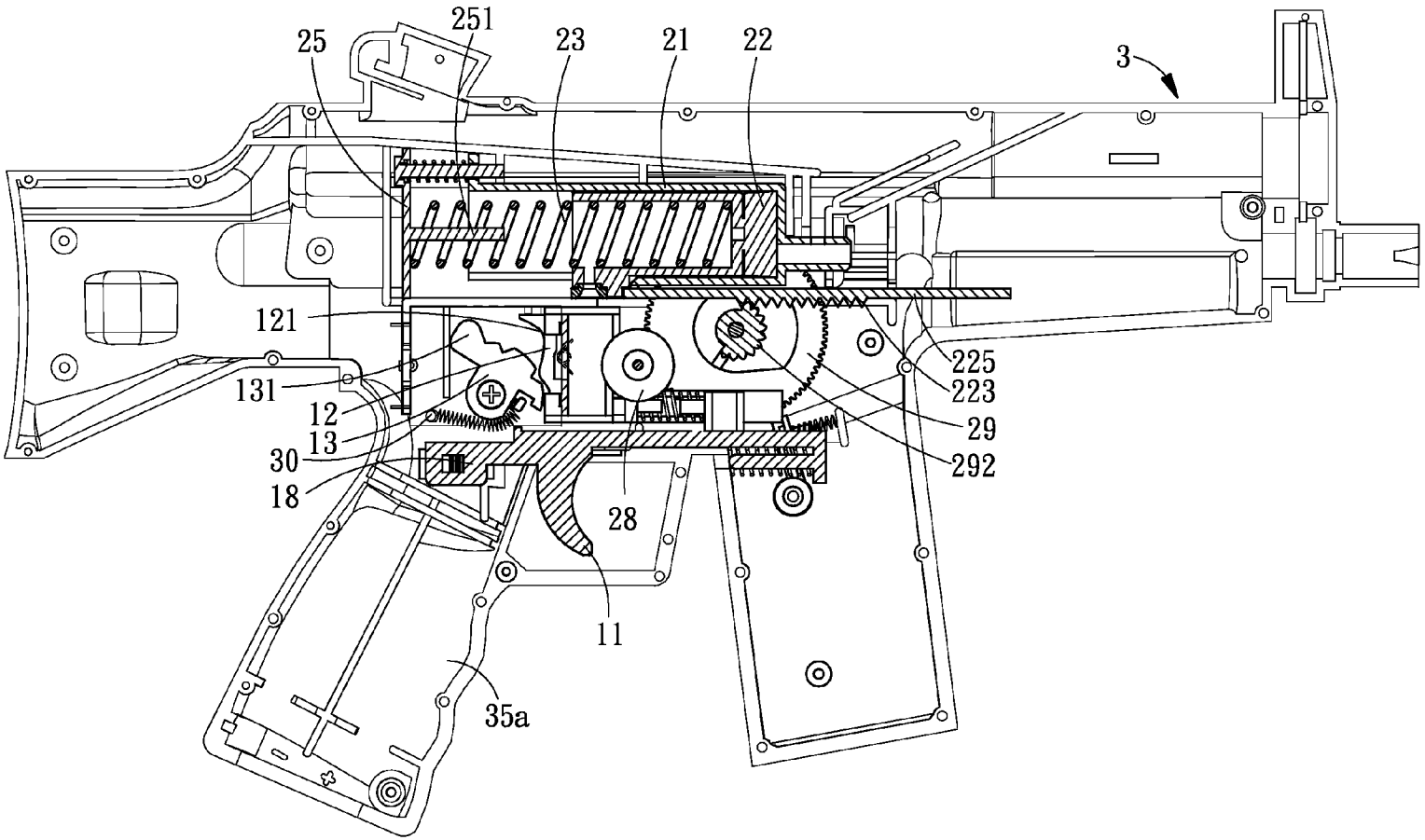
FIG. 7 is a fragmentary cross-sectional view (II) of the other embodiment of the assembled electrically driving toy gun structure of the invention.

FIG. 6~FIG. 7 are fragmentary cross-sectional views of the other embodiment of the assembled electrically driving toy gun structure of the invention. As shown in FIG. 6 and FIG. 7, the operator pulls the pull knob (17) backward to drive the propping up plate (13) to rotate and makes the salient portion (131) completely separate from the upper recess portion (121), afterward, lightly presses the trigger (11). At this moment, the inserting hole (118) at the distal of the cross-slot rail (112) is exactly aligned with the corresponding power switch (18) that is switched on due to the backward displacement of the trigger (11). At this moment, the power supply makes the motor (4) rotate that let the tooth portion (41) drive the rear tooth portion (281) of the small transmission gear (28) to transmit the power to the corresponding meshing tooth portion (291) of the large transmission gear (29) and to drive the lower dent (223) of the piston (22). Consequently, it makes the piston (22) generate continuous reciprocating motion to shoot off the plastic bullet.

At the time when the operator shoot off the plastic bullet, since the large transmission gear (29) mostly will generate continuing high speed idling due to the inertia motion after it reverts to the original position from reciprocating motion, a misalignment gear meshing between the transmission tooth portion (292) of the large transmission gear (29) and the lower dent (223) of the piston (22) often happens disregarding whether it is manually or electrically shooting. In order to avoid this phenomenon to be occurred, a salient portion (293) is furnished at the corner root portion between the transmission tooth portion (292) of the large transmission gear (29) and the tooth portion (291). This salient portion (293) is disposed to be corresponding to the lower dent (223) and sliding plate (225) of the piston (22). As the piston (22) reverts to the original position, the salient portion (293) of the large transmission gear (29) and the sliding plate (225) of the piston (22) are exactly pressed against each other that is capable of completely stopping the continuing idling of the large transmission gear (29), thereby avoiding the misalignment between the meshing teeth.

It is known from the above-mentioned description that the duplex control structure of toy gun of the invention is capable of instant shooting of plastic bullets by the use of driving action of electrical motor or directly switching to manually driving action when the power is used up. In addition, the duplex control structure of toy gun of the invention makes use of the piston that is subjected to the predetermined resilient action of the restoring spring to instantly compress the air in the gun machine socket (21) for shooting off the plastic bullets. What is more, the control structure of the duplex control structure of toy gun of the invention is capable of switching back-and-forth to perform single and continuous multiple shooting.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A duplex control structure of toy gun comprising a main body (3), a control portion (1), a transmission portion (2), and a motor (4); the main body (3) further consisting of a left and right main bodies (3*a*), (3*b*), a barrel (31), two motor's positioning plates (32*a*) and (32*b*), a multiplicity of supporting shaft rods (33), (34), a left and right handle portions (35*a*), (35*b*), check plates (36*a*), (36*b*), and two sliding ways (37*a*), (37*b*); the control portion (1) further consisting of a trigger (11), a control rod (12), a propping up plate (13), a brake (14), a slider rod (15), a positioning plate (25), a pull knob (17), and a power switch (18); the transmission portion (2) further consisting of a gun machine socket (21), a piston (22), springs (23), (24), a positioning plate (25), a check piece (26), a clip piece (27), a small transmission gear (28), and a large transmission gear (29); the motor (4) being connected to a DC power supply; the duplex control structure of toy gun is characterized by that the control portion (1), transmission portion (2), and motor (4) are sequentially installed in the left and right main bodies (3*a*), (3*b*); the pull knob (17) is threaded through the outer portion of the main body (3) to the propping up plate (13); by making use of the pull knob (17) to drive the propping up plate to press against or separate from the corresponding control rod (12) in accommodating the action of the positioning plate (25) of the control portion (1) is capable of achieving the duplex driving functions of manually and electrically shoot toy gun.

2. The duplex control structure of toy gun as claimed in claim 1, wherein the trigger (11) has a salient post (111) that is furnished in the front section on the top thereon; a post rod (113) furnished in the front section under the trigger (11) with a slipped on spring (115), as well as a slant portion (114), a flange (117), and a cross-slot rail (112) in the rear section where the cross-slot rail (112) has a inserting hole (118) that penetrates through underneath thereof.

3. The duplex control structure of toy gun as claimed in claim 1, wherein the control rod (12) has an upward raised goose neck that is provided at the rear section with a upper recess portion (121), lower recess portion (122), a slant surface (123), and a salient portion (124); as well as an end surface (125) formed at the front end.

4. The duplex control structure of toy gun as claimed in claim 1, wherein the propping up plate (13) has a threaded hole (132) for a screw (133) to thread in, a salient portion (131) extended upward, and a hook portion (135) for hooking a spring (134) at the lower end thereof.

5. The duplex control structure of toy gun as claimed in claim 1, wherein the brake (14) has a shaft portion (143) with a penetration hole at the lower end thereof, a check plates (141) having a salient portion (142) with a slipped on spring (144).

6. The duplex control structure of toy gun as claimed in claim 1, wherein the control portion (1) has a dented edge (151) that is furnished at the lower end of the slider rod (15) thereof.

7. The duplex control structure of toy gun as claimed in claim 1, wherein the control portion (1) has a recess portion (161) that is provided in the middle section of the positioning plate (16) thereof, a sliding slots (162) and a salient portion (163) furnished on the back side for a spring (164) to be hooked.

8. The duplex control structure of toy gun as claimed in claim 1, wherein the gun machine socket (21) has a penetration tube hole (211) that is formed therein, a sliding slots (2111) that is furnished at the wall edge of the rear open end thereof, an outlet end (212) at the front end, a wing plate (214) on each side thereof, and a lug (215) with a penetration hole (2151); a check portion (213) is also provided on a side of the wing plate (214) near the sliding slot (2111).

9. The duplex control structure of toy gun as claimed in claim 8, wherein the gun machine socket (21) being a counter part of the piston (22) has a non-penetrating tube hole (221) that is formed within the gun machine socket (21) and a horizontal sliding plate (225) integrally formed with the gun machine socket (21); the sliding plate (225) has a lower dent (223) and a breach (224) that are furnished in the middle section on a side thereof; a salient portion (222) that is provided at the open end of the non-penetrating tube hole (221) and is corresponding to and combined with a gun machine pulling handle (226) has a slot (2261) and a salient portion (2262) that are furnished on a side thereof.

10. The duplex control structure of toy gun as claimed in claim 8, wherein the positioning plate (25) has two columns (251) and (252); the positioning plate (25) has its column (251), after being slipped on by the spring (23), that is inserted into the non-penetrating tube hole (221) of the piston (22) while the column (252), after being slipped on the spring (24), is inserted through the corresponding hole (2151) of the lug (215) on the gun machine socket (21).

11. The duplex control structure of toy gun as claimed in claim 1, wherein the check piece (26) being a plate in shape has a horizontal bent portion (263) at the top end thereof, a salient portion (261) that is provided at the top surface of the horizontal bent portion (263) for a spring (264) to be slipped on, and a chamfer (262) at a corner of the lower end thereof

12. The duplex control structure of toy gun as claimed in claim 1, wherein the small transmission gear (28) has a front tooth portion (282) at one end and a rear tooth portion (281) at the other end.

13. The duplex control structure of toy gun as claimed in claim 1, wherein the large transmission gear (29) has a tooth portion (291) at one end, a transmission tooth portion (292) at the other end, a salient portion (293) on a side, and a shaft hole (294) penetrated through the center thereof.

* * * * *